US007335399B2

(12) United States Patent
Bolton et al.

(10) Patent No.: US 7,335,399 B2
(45) **Date of Patent: *Feb. 26, 2008**

(54) PROCESS FOR IMPARTING A WOOD COLOR AND GRAIN TO A SUBSTRATE

(75) Inventors: James A. Bolton, Shelton, CT (US); Timothy J. Bolton, Stratford, CT (US); Louis R. Zayas, Stratford, CT (US)

(73) Assignee: Grafted Coatings, Inc., Seymour, CT (US)

( * ) Notice: Subject to any disclaimer, the term of this patent is extended or adjusted under 35 U.S.C. 154(b) by 315 days.

This patent is subject to a terminal disclaimer.

(21) Appl. No.: 10/795,947

(22) Filed: Mar. 8, 2004

(65) Prior Publication Data

US 2005/0239931 A1 Oct. 27, 2005

(51) Int. Cl.
*B05D 1/38* (2006.01)

(52) U.S. Cl. ..... 427/264; 427/261; 427/262; 427/358

(58) Field of Classification Search ..... 427/264, 427/261, 262, 358
See application file for complete search history.

(56) References Cited

U.S. PATENT DOCUMENTS 4,432,797 A * 2/1984 Vasishth et al. ..... 106/34
5,534,352 A * 7/1996 Pittman et al. ..... 428/535
6,201,057 B1 * 3/2001 Porter ..... 524/501
7,097,879 B2 * 8/2006 Bolton et al. ..... 427/264

* cited by examiner

*Primary Examiner*—Fred J. Parker
(74) *Attorney, Agent, or Firm*—Thaddius J. Carvis

(57) ABSTRACT

A kit and a process for using it to impart wood grain appearances are provided. According to the method, a base coat comprising an opaque, pigmented, water-based paint emulsion is applied to a wood-grain textured substrate and dried. Then, a pigmented, water-based graining coat (most preferably a crosslinkable urethane/acrylic) is applied sparingly, preferably by use of a dampened foam/sponge pad or sprayed, in an amount sufficient to overcoat the base coat and color at least a majority of texture recesses in the substrate and drying. According to the kit aspect of the invention, the kit will comprise: an opaque, pigmented, water-based paint emulsion; a pigmented, water-based graining coat emulsion, optionally packaged in a bottle, such as one with a spray. Optionally, the kit can include an applicator or surface cleaner, a scraper, brush, cloth, sponge, or combination. The process of the invention can be completed within 3 to 12 hours at temperatures ranging from just over 55° F. up to over 85° F., with sufficient time for working both coatings yet without long periods of time where the door or other object is out of service. Timing and ease of application facilitate application by home handyman as well as the professional.

8 Claims, 2 Drawing Sheets

PROCESS FOR IMPARTING A WOOD COLOR AND GRAIN TO A SUBSTRATE

PRIORITY

This application claims priority to U.S. patent application Ser. No. 10/657,612, filed Sep. 8, 2003, now U.S. Pat. No. 7,097,879 which in turn claims priority to U.S. Provisional Patent Application No. 60/408,573, filed Sep. 6, 2002, which are both incorporated herein by reference in their entireties.

BACKGROUND OF THE INVENTION

The invention relates to a new process and a new kit for applying a natural appearing wood grain to a door, window or other item or component made of any suitable material having a wood grain texture. The appearance of the final finish is highly durable, very simple and rapid to apply and results in a finish which can closely simulate the appearance of natural clear coated wood. The invention achieves these long-standing industry objectives without the use of a clear coat of the type that is highly sensitive to failure due to yellowing and delamination, problems that have plagued the industry looking for a successful wood graining process for simulated wood textured surfaces.

Many of the problems with achieving a natural wood appearance in a simulated wood door have been addressed and solved by the art. U.S. Pat. No. 5,075,059 to Green, for example, describes a method which includes a first step of compression molding fiber reinforced polyester door skins with closed areas dense with deep grains, open areas with a generally lesser concentration of deep grains and reduced depth grains adjacent steeply angled trim areas. The open areas have a predetermined roughness, which is provided by the mold half used in compression molding. In the subsequent steps, the molded door skin is sprayed with a mixture of artist's oil cut 1:1 with mineral spirits on a fluid ounce basis. After twenty minutes, the sprayed mixture is rubbed into the external surface, and the door skin is then placed vertically in a forced air oven for about one hour at about 120° F. Drying under ambient conditions takes far longer and is not practical in many situations. Also, the color layer is not bonded to the substrate and will easily peel off with an overcoat material, such as the standard final step urethane top coat, which Green states may be applied to the dried coloring layer. By providing deep grains of varying density over most of the door skin surface, but reduced grain depths adjacent to steeply embossed or bossed trim sections, the external surfaces of the panel door are said to more realistically simulate a wood grain appearance, while the reduced depth of the grains in steeply angled areas minimizes risk of deformation during mold release. Unfortunately, because the achievement of color depends on the first coloring step and a clear overcoat, durability is less than might be desired.

The prior art that relies upon the use of a transparent or pigmented translucent mixture as a first coat requires the user to have a good sense of color selection and matching. This need is exaggerated by the fact that different manufacturers of doors and other trim parts provide their own substrate base colors. Even though two pieces might seem to be the same "white" color, they are often different in the way that they receive the stain. This makes it difficult for a homeowner to properly match colors. Also, distinctly different base colors will cause distinctly different stained colors. Even where the manufacturer tries to match substrate color, it is common to employ trim pieces, such as around a window or sidelight, of different materials from the main structure. The use of a staining pigment layer as the first coat cannot be applied by other than the most skilled workers to match colors between components and even then the finish has inherent limitations due to its makeup.

In U.S. Pat. No. 5,534,352, Pittman, et al., describe a process for pre-finishing wood composite panels and/or structures having flat and contoured surfaces to result in a structure exhibiting the appearance of natural hard wood. The process includes a number of steps designed to facilitate industrial scale, machine production. To that end, they employ a ground coat in a first step, then a non-adherent "dry buffing glaze" which is selectively removed, and finally they apply a sealer to retain the remaining buffing glaze in textured ticks of the substrate. The dry buffing glaze is preferably a waterborne coating, applied to the substrate as a liquid and then flash dried to yield a dull powdery appearance. The true color of the glaze is not evident until it is wetted in a subsequent toning or top-coating step. The glaze has a high proportion (e.g., at least about 80 weight %) of inert pigments so as to make it powdery and easily buffed from flat surfaces of the substrate. This type of powdery buffing composition, unfortunately, has no bonding capability to the base and tends to provide a plane of weakness where the ultimate glazed finish can easily separate. When separated, the finish is irreparably discolored in the area of the separation. The use of a clear glaze is necessary for protection of the color, but is highly susceptible to ultraviolet light damage. Clear finishes of this type rapidly yellow and lose their initial physical strength.

The Pittman, et al., patent makes it clear that the product is not complete following the pre-finishing process, but is further prepared and finished or semi-finished. The process is not simple, such as would be suitable for a home decorating project. They make this clear indicating that the process requires machine operation. They emphasize that, if the substrate were hand-rubbed during this step, the pressure of a glazing cloth could wipe the glaze out of the wood grain ticks—yielding a less realistic appearance. Following the buffing operation, a sealer is applied to bind the dry buffing glaze to the substrate and protect the panel finish during storage, shipping, and handling of the pre-finished substrate. The clear sealer, preferably a clear acrylic sealer, is sprayed on the substrate. The clear sealer also renders the substrate receptive to lacquer or solvent-based glazes and toners that may be applied to the substrate as a final finishing step. The basic process is difficult to perform and results in a coating that has limited adherence to the substrate, has limited durability and cannot be easily repaired.

One commercial form of wood graining kit, available from Pease Industries, Inc., of Fairfield, Ohio, is a solvent-based system comprising a wood stain and a clear topcoat. The literature on using the kit states that the stain is applied on a door using a lint-free cloth in a circular motion, working the stain into the embossed grain pattern. Next, a stain cloth is used to smooth the stain in the direction of the grain. The directions specifically say that excess stain should not be wiped off. Working the same area with a clean soft bristle brush to gently feather-out any streaks or lap marks follows this. If the stain color is not satisfactory, the stain can be cleaned off with mineral spirits before it dries, and applied again. If the first coat is too light, the literature suggests waiting 48 hours before a second coat is applied in the manner of the first coat. To complete the job, a polyurethane topcoat is then applied. The stain must be thoroughly dry before top-coating—48 to 72 hours drying time is recommended.

Another type of commercial graining kit has been available with an opaque stain as one coat and a dark graining coat. The opaque coat would uniformly cover the surface being worked on and allowed to dry. Then, the dark graining coat would be applied with a brush or the like to paint on a grain pattern. Thus, the graining depended upon the artistic ability of the person doing the work.

In an attempt to directly coat synthetic molded doors, which are generally nonporous, U.S. Pat. No. 6,358,614 to Porter describes a weatherable coating based on a stain/topcoat system. The coating comprises a pigmented stain having substantially a single binder resin, which promotes adherence of a topcoat and a topcoat that is an aqueous dispersion of a film forming polymer and a curable organopolysiloxane microemulsion. The topcoat is said to display exceptional adhesion and weatherability to surfaces stained with the specially formulated pigmented stain. U.S. Pat. No. 6,120,852 and U.S. Pat. No. 5,948,849 are directly related.

The Porter coating is applied in two steps: a specially formulated pigmented stain coating and a compatible transparent topcoat. The stain is a solvent-based composition containing from 20 to 40% of a volatile solvent such as slowly evaporating solvents and solvents that exhibit fast to moderate evaporation, such as mineral spirits, naphtha, petroleum distillate, and the like. The topcoat is aqueous and includes from 25 to 55% of a water-dispersible non-polysiloxane film-forming polymer, 2 to 25% of a curable organopolysiloxane in the form of an emulsion and water superficial to the pigmented stain coating. The use of the curable organopolysiloxane emulsion is said to be necessary to make the topcoat compatible with the specially formulated stain. The use of solvents is, of course, less than desired, and the stain coat can provide a less than complete color treatment that must be preserved with a topcoat.

The Porter stain is applied directly to a non-porous thermoset and/or thermoplastic composite by conventional means, i.e., by brushing, spraying, sponging, rolling, wiping, and the like. The stain is specially formulated for these nonporous surfaces and excess stain is removed by wiping with a clean lint free rag, a china bristle brush or the like. The stain is generally allowed to dry for approximately 48 hours at room temperature under dry conditions. After the stain is dry, the topcoat is applied, preferably as two layers, with a total dry thickness of 10-100 μm. The topcoat is preferably applied as two layers and dried for three hours between coats.

There remains a need for a process and a kit useful for imparting a durable, realistic wood-grained appearance to a wood-grain-textured substrate. There is particular need for a simple process and means for imparting a realistic, durable wood-grain appearance to molded doors, windows and other wood-simulating panels, composites or components, which have one or more surfaces textured to simulate the regular grain patterns of ticks associated with any of a variety of types of wood.

SUMMARY OF THE INVENTION

It is an objective of this invention to provide a new process and a new kit for applying a natural appearing wood grain to a door, window or other item or component made of any suitable material having a wood grain texture.

It is an objective of the invention to develop proper color foundation for the system over any color door skin (some door skins are green, white, gray, etc.).

It is another objective of the invention to provide a process for finishing wood grained substrates which is capable of controlling the final color by painting the door to establish a uniform background color, tightly bonded to any substrate material, which is finally finished to match natural wood by the application of a pigmented coating having a complimentary coloration.

It is another objective of the invention to provide a well defined process for color reproducibility that does not rely on the supplied color of the door, itself.

It is another objective of the invention to provide a process for finish wood grained substrates, which provides realistic simulations of the natural color of any of a number of wood species selected or desired by the user (oak, pine, birch, ash, cherry, teak, maple, hickory, etc.).

It is another objective of the invention to provide a kit and a process for using it to impart wood grain appearances which not only appears easy, but is easy in fact for typical homeowner use.

It is another objective of the invention to provide a kit and a process for using it to impart wood grain appearances which provides professional-appearing results in two easy steps.

It is another objective of the invention to provide a kit and a process for using it to impart repairable wood grain appearances.

It is another objective of the invention to provide a kit and a process for using it to repair wood grain finishes applied in accord with the invention.

It is another objective of the invention to provide a kit and a process for using it to impart wood grain appearances which provides professional-appearing results in a very short application time.

It is another objective of the invention to provide a kit and a process for using it to impart wood grain appearances applied as two thin coats, each using low volumes per unit area and being low cost in terms of materials and labor.

It is yet another objective of the invention to provide a multi-coat finishing kit and a process for using it for imparting a wood appearance to a wood grained substrate which is durable to ultraviolet light and physical abrasion.

It is yet another objective of the invention to provide a kit and a process for using it to impart wood grain appearances to wood-textured surfaces having a durability similar to finished natural wood.

It is a still further objective of preferred forms of the invention to provide a kit and a process for using it to impart wood grain appearances to wood-textured surfaces having a glossy surface that appears similar to finished natural wood initially and maintains gloss for extended periods of exposure to sun and weather.

These and other objectives are achieved by the present invention, which provides a kit and a process for using it to impart wood grain appearances. The invention provides two complimentarily formulated coating compositions for use together to finish and or refinish a wood grained substrate to achieve durable, realistic wood appearances.

The process of the invention comprises: applying a base coat comprised of an opaque, pigmented, water-based paint emulsion, to a wood-grain textured substrate and drying the base coat; and, then, sparingly applying a pigmented, water-based graining coat (most preferably a crosslinkable urethane/acrylic) in an amount sufficient to replicate a predetermined wood color and provide darkening color to texture recesses in the substrate, and drying the applied coating.

In more narrow aspects, the process for imparting a wood grain to a textured surface having a pattern of texture surfaces with recesses therein, will comprise:

(1) applying to a wood-grain textured substrate an opaque, pigmented, water-based paint emulsion base coat comprising a) a crosslinkable acrylic polymer;

b) a surfactant component;

c) a water-soluble, aqueous solvent for the polymer; and d) a pigment component;

(2) drying the base coat;

(3) applying to the base coat following drying, a water-based, pigmented graining coat in an amount sufficient to replicate a predetermined wood color and provide darkening color to texture recesses in the substrate, comprising a) a water reducible alkyd;

b) a surfactant;

c) a water-soluble, aqueous solvent for the polymer; and d) a pigment component, wherein the crosslinkable polymer provides a finish that faithfully reproduces the coloration and graining of a predetermined wood in a brilliant finish characterized by ultraviolet light stability and chemical resistance; and (4) drying the graining coat to provide a final durable finish.

In another aspect of the invention, the compositions described in the paragraphs directly above are provided together in a kit.

In yet another aspect of the invention, the compositions described in the paragraphs directly above are available together with instructions for repairing marring or other damage to a wood grained object finished by the process of the invention.

According to a preferred form of the kit aspect of the invention, the kit will comprise: an opaque, pigmented base coat comprising a water-based paint emulsion; a pigmented, water-based graining coat emulsion; and an applicator. Surprisingly, a 32 square foot paneled door can be grained with only about 1.5 to 3.0 ounces of graining coat. The applicator can comprise one or more of a brush, a cloth, a sponge, a scraper, or the like.

A number of preferred aspects of the invention will be described below.

BRIEF DESCRIPTION OF THE DRAWINGS

The invention will be better understood and its advantages will become more apparent when the following detailed description is read in light of the accompanying drawings, wherein.

DETAILED DESCRIPTION OF THE INVENTION

The process and kit of the invention have particular advantage in applying a wood-grained appearance to a grain-textured substrate. The invention has particular advantage for imparting a realistic wood-grain appearance to molded doors, windows, trim and other wood-simulating panels, composites or components, which have one or more surfaces textured to simulate the regular grain patterns of ticks associated with any of a variety of types of wood. The process and its component compositions enable finishing grained textures and perfectly matching them to ungrained components virtually independent of grain, material or texture. Essentially, if a manufactured wood replacement product is available commercially, it can be effectively finished by the compositions of the invention and color matched with associated parts of the same or different manufacturer. The process of the invention can be completed within 3 to 12 hours at temperatures ranging from about 55° F. up to about 85° F., with sufficient time for working both coatings yet without long periods of time where the door or other object is out of service. This is of great value to home handyman as well as the professional.

Figure 1:
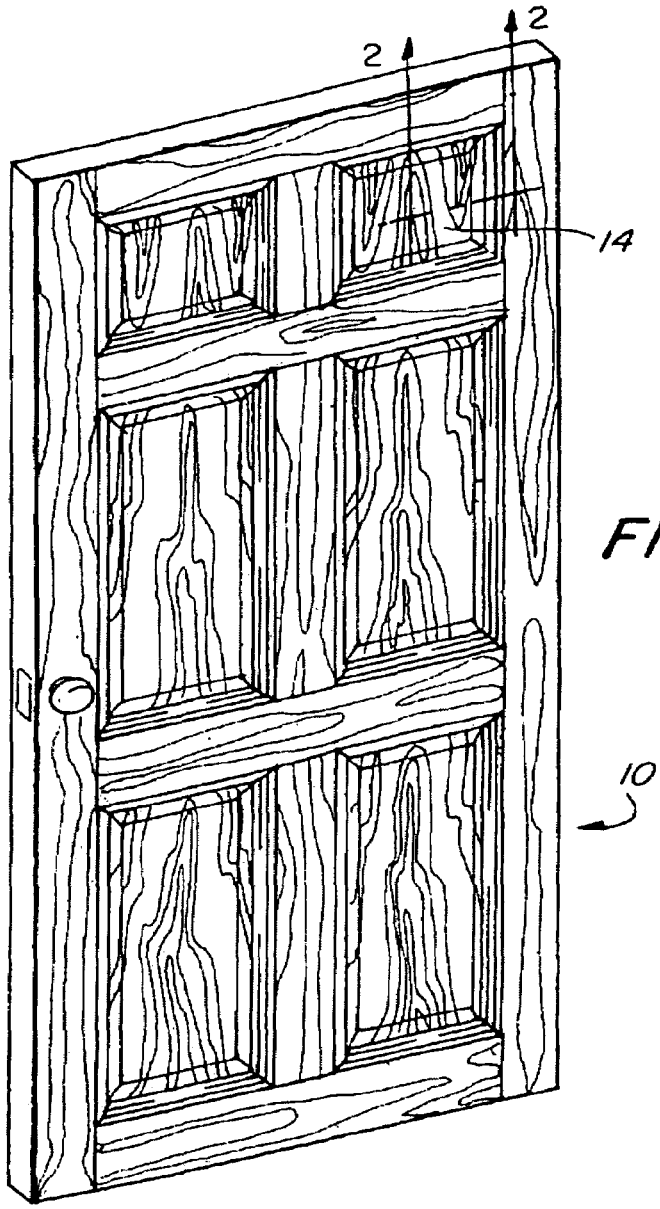
FIG. 1 is a perspective view of a six-paneled, wood-textured door of the type that can be given a wood grain in accord with the invention.

FIG. 1 shows a substrate of a preferred type that can be finished according to the invention. The door 10 can be a molded door of the types available, for example, from Masonite Corporation and as illustrated and/or described in the above cited U.S. Pat. No. 5,075,059 to Green, U.S. Pat. No. 5,534,352 to Pittman, et al., and U.S. Pat. No. 6,358,614, to Porter. These patents are incorporated by reference for their descriptions of suitable wood-grained substrates. Fiberglass and carbon doors and windows available from Pease Industries, Inc., of Fairfield, Ohio, under the trademark Ever-Strait® also provide suitable wood grain textured substrates. The substrate can be a wood composite, of all wood or of a suitable molded polymer, either thermoplastic or thermosetting, preferably containing a suitable filler. Also of use are metal substrates and those based on cementitious or gypsum-based materials. In some cases, the grained surface is primed and in some cases priming is unnecessary. Indeed, there is no known limitation on the material or method of manufacture of the substrate.

Figure 2:
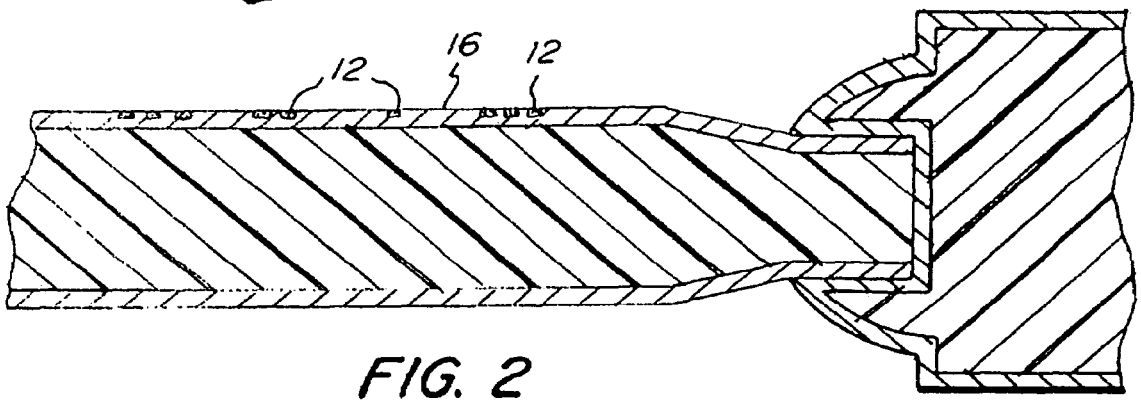
FIG. 2 is a sectional view, taken across line 2-2 in FIG. 1, showing the textured top surface of a section of the door illustrated in FIG. 1.

The wood-grain texture in the door 10 is provided by molded or formed recesses, known as ticks, shown generally as 12 in the detail of FIG. 2. The ticks 12 are arranged in a suitable grain-like pattern, shown generally as 14 in a surface 16 that is raised above the ticks, to provide a wood-like grain texture. The coating kit and the process of the invention will impart wood grain appearances which make substrates of the type described appear essentially the same as a well-finished natural wood door. According to the method of the invention an opaque, pigmented, water-based basecoat is applied to any suitable wood-grain textured substrate and dried. Then, a pigmented, water-based graining coat is applied sparingly in an amount sufficient to replicate a predetermined wood color and provide darkening color to texture recesses in the substrate (i.e., ticks 12) and dried.

Figure 3:
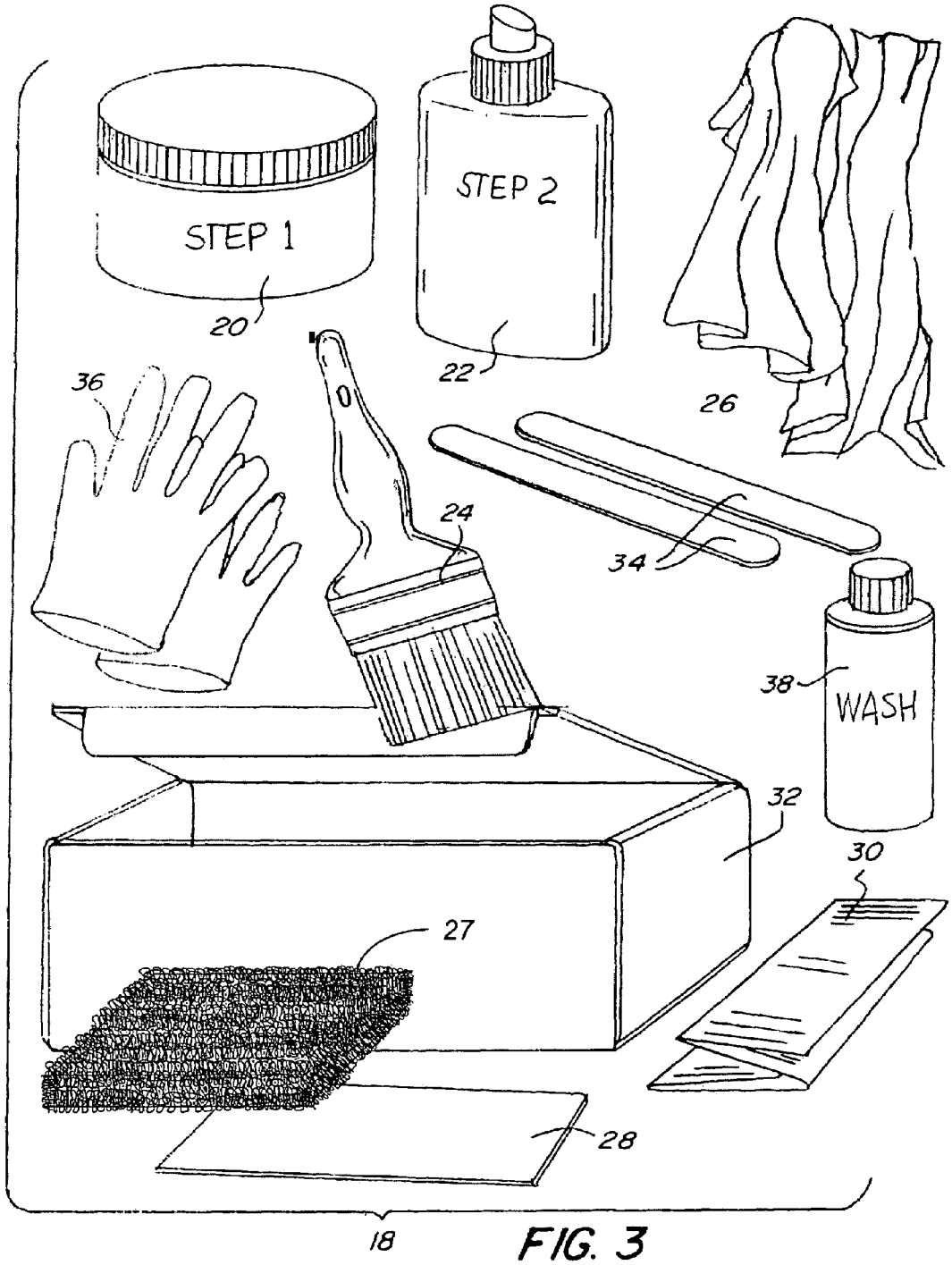
FIG. 3 is a schematic view showing the component parts of one embodiment of a kit according to the invention.

According to the kit aspect of the invention, the kit 18 will comprise as shown in FIG. 3: an opaque, pigmented, water-based base coat, which is applied to a wood-grain textured substrate—referred to herein as Step #1 coat 20, and a pigmented, water-based graining coat—referred to herein as Step #2 coat packaged in a bottle 22 or other suitable container, which may utilize a spray cap as shown. A preferred container is a bottle with a cone top to facilitate laying down a grain amount similar in a manner similar to squeezing toothpaste from a toothpaste dispenser. Surprisingly, a 32 square foot paneled door can be grained with only about 1.5 to 3.0 ounces of graining coat. The base coat is typically applied 3 to 3.5 mils thick and the grain coat is typically applied 0.05 to 1 mil thick. Both are approximately 50% of the applied wet thickness when dry. An applicator such as a brush 24, cloth 26, sponge pad 27 (which may be terrycloth covered as shown), scraper 28, or the like, to apply and/or remove the graining coat, are optional components. An instruction sheet, shown in more detail in FIG. 4, is shown as 30. All can be packaged together in box or the like 32. It will be noticed-upon opening the kit and looking at the individual coating compositions, that neither has a color representative of the selected finish, be it oak, cherry, pine, maple, or the like. The first coating composition, Step #1 coat, looks like a heavily pigmented paint. The second coating composition, Step #2 coat, is pigmented dark, but not so heavily as to wholly obscure the color of the Step #1 coat. The combination, with the base color being partially screened and color modified by the Step #2 coat, results in a final dry color that consistently and predictably reproduces the type of wood finish intended.

The preferred manner of applying the "Step #1" coat is to spray or brush it on in the same manner as any quality paint is referred to herein as a base coat and comprises a paint emulsion. By the term "paint emulsion" we mean an air dryable coating composition for providing a selected background color for a two-component wood graining process. It is essentially a paint, but some marketers in the industry might call it an opaque stain. In its preferred forms, the Step #1 coating will dry quickly, e.g., in from 30 to 90 minutes at 70° F., will spray or brush on smoothly to form a drip free, opaque coating on a vertical surface to a wet thickness of from 3 to 3.5 mm , will be water-based, will have a total solids content of about 38 to 45 weight %, e.g., about 41%, and will have a pigment solids content of about 8-10 weight %, e.g., about 9%. Step #1 coat provides a uniform background color—something difficult to achieve where the first step is a regular stain-type material which tends to be translucent. The Step #1 coat is desirably a crosslinkable acrylic water-based system, e.g., an exterior grade (non yellowing) preferably styrene free latex acrylic. It can be of the self crosslinking type or it can be a crosslinkable system with additional crosslink agent added just prior to application. A preferred viscosity for the Step #1 coat will be about 35 to 50 Zahn seconds, using a #3 cup.

A preferred composition for the Step #1 coat will contain 40 to 80% of a crosslinkable acrylic, e.g., a self crosslinking acrylic or an acrylic to which a crosslinking agent is added. Among the acrylics are exterior grade (non yellowing) acrylics, preferably styrene free latex acrylic. The preferred compositions will also contain, e.g., from 2 to 25 % pigment (lower amounts of less than 10% are effective), from 0.3 to 0.5% surfactants, 0.4 to 0.8% thickeners, 4 to 10% water, 5 to 8% cosolvents and 1 to 3% dispersants, these materials being combined and formulated in accord with procedures known to the art. It is important that Step #1 possess strong adhesion to the many varieties of substrates to be coated such as: primed steel doors, fiberglass doors, wood doors and composite doors. Preferred formulations provide adhesion to the many types of door glass moldings comprised of acrylic, polyvinyl chloride (PVC), styrene, and more. Furthermore, Step #1 desirably has outstanding flow and leveling to obtain uniform coverage on the surface of any substrate with a simulated wood grain, or ticks. This coverage ensures adhesion to adequate coating dry mil thickness on the entire surface of the door for: opacity and effective two-step application process, and to ensure longevity, and durability of the coating to the exterior elements.

It is advantageous that the preferred compositions for the Step #2 coat contain an acrylic, e.g., urethane/acrylic polymer hybrid, which provides durability, ease of application and sufficient open time for good workability. These coatings due to the acrylic and the pigments used therein have a good surface gloss upon drying and maintain it for extended periods of exposure to the sun and the elements. Compositionally, the crosslinkable urethane/acrylic component is of the self crosslinking (oxidative cross linking) type, or it can be a crosslinkable system where additional crosslink agent is added just prior to application. It is preferably of the water reducible type, characterized by chemical resistance to environmental factors, giving it good exterior durability. Compositionally, the surfactant component is preferably of the non-silicone type, characterized by a combination of nonionic and anionic surfactants having defoaming activity. Compositionally, the solvent component is water miscible, and preferably of the glycol type, characterized by a low content of hazardous air pollutants. The preferred solvents, some of which are exemplified, have low boiling points and enhance quality film formation. The pigments can be any of those typically used in similar compositions, such as raw umber, burnt umber, raw sienna, titanium dioxide, yellow oxides, black, red oxides, rutile titanium, various blends of these with other colored pigments and dyes.

The Step #1 coat is a pigmented coating formulated in a manner effective to produce a uniform background coloring coating. As noted above, this solves a very significant problem with systems based on transparent or translucent stains as a first coat. It is formulated to have a consistency effective to provide a uniform, thin coating over the surface of application and be of a suitable consistency to be easily spread into grain-defining ticks on the surface of the substrate, without filling the ticks. When applied simply by brushing or spraying in an amount sufficient to uniformly color the substrate, the ticks are still large enough to easily receive and be colored by the Step #2 coat as will be described below. The combined use of a base coat with a graining coat as provided by the invention provides a brilliance and depth of natural wood simulation that is distinctly different than achieved by prior art methods. For this coating to be so weather resistant is surprising for any coating but especially for one so beautiful and easy to apply. The brilliance is attributed to the provision of an opaque background and a very light, transparent but darkening graining coat. The two colors are compatibly selected to provide a natural look of any selected wood type, e.g., oak, maple, cherry, walnut, pine, and the like.

The preferred manner of applying the "Step # 2", "grain" coat is to apply it lightly onto the substrate in an amount sufficient to replicate a predetermined wood color and provide darkening color to texture recesses in the substrate (i.e., ticks 12). A physical contact applicator such as a brush, cloth, scraper, sponge or combination device, or a spray can be used. In the case of the spray, a mist is sparingly applied to the substrate coated with the Step #1 coat. The application is desirably applied at a rate of from about 1 to 3 ounces per 32 square feet of area, preferably at about 1.5 ounces. The Step # 2 coat can be smoothed, preferably by dry brushing, and cleared of any excess in a manner effective to replicate a predetermined wood color and provide darkening color to texture recesses in the substrate (i.e., ticks 12), e.g., at least a majority the grain defining ticks on the surface of the substrate. In an alternative method the grain coat is applied with a brush, cloth, scraper, sponge or combination applicator can be helpful. More or less of the composition can be employed as desired, but the amounts indicated give good results. The spray bottle application is simple and provides surprisingly rapid and uniform application with surprisingly little grain coat composition.

In a preferred form the Step # 2 is applied sparingly with little excess to be removed, and the surface having the sprayed on Step # 2 coating material can be simply dry brushed, rubbed with a foam/sponge pad, brush, cloth or the like, to assure applying the contrasting color of the Step # 2 coat into the grain-representing ticks. If desired, the Step # 2 coat can be applied with a dampened cloth or the like. Also, while not preferred, the Step # 2 coat can be brushed on and then squeegeed off with a straight edge (e.g., of paper, plastic, rubber or the like) to clean the raised surfaces 16 and move the Step # 2 coat into the ticks 12. A preferred viscosity for the Step #2 coat is a semi-gel consistency graining coat as provided by the invention provides a brilliance and depth of natural wood simulation that is distinctly different than achieved by prior art methods. For this coating to be so weather resistant is surprising for any coating but especially for one so beautiful and easy to apply. The preferred compositions will contain pigment concentrations sufficient not only to alter the visible color of the base coat but also to provide a degree of ultraviolet light stability greater than cannot be achieved with the clear coating compositions of the prior art. The combined coatings of the invention provide a brilliance of color initially and after weathering that can be attributed to the provision of an opaque background and a very light, transparent but darkening graining coat. The two colors are compatibly selected to provide a natural look of any selected wood type, e.g., oak, maple, ash, maple, hickory, cherry, walnut, pine, and the like. The colors can be selected from a virtually infinite pallet, but once selected and comprised in the kit of the invention, will enable the faithful reproduction of the desired wood coloration to virtually any commercial substrate, grained or ungrained. Because both coating layers of the invention are highly adherent, and the base coat is very highly pigmented, the coating does not peel after weathering in the manner of prior art coatings. This makes for superior durability and enables repair of abrasions or the like.

In its preferred forms, the Step #2 coating will set to touch in about 1 to 3 hours at 70° F. (depending on humidity), and will dry through in 24 hours. It will spray, wipe or brush on easily, will be water-based, will have a total solids content effective to replicate a predetermined wood color and provide darkening color to texture recesses in the substrate. Preferably, the solids content will be from about 10 to 20 weight %, e.g., about 11-14%, and will have a pigment solids content of about 4 to 12 weight %, e.g., about 10-11%. A preferred composition for the Step #2 coat will contain 10 to 30% of a suitable acrylic, e.g., an alkyd/acrylic (e.g., a 3:1 blend, weight of alkyd paint to weight emulsified acrylic) or a urethane/acrylic, 4 to 25% pigment, from 0.1 to 1% surfactants, 0.1 to 2% thickeners, 4 to 80% water, 1 to 10% solvents and 1 to 3% dispersants, these materials being combined and formulated in accord with procedures known to the art. Preferred ranges are illustrated in the examples, and less preferred formulations will vary those specific values can be modified by up to 50%, or more preferably less than 25% of the indicated amounts. Drying can be done by air or assisted with ovens or halogen lamps as illustrated below.

A preferred form of kit 18 according to the invention is shown in FIG. 3 as comprising: a container 20 of opaque, pigmented, water-based stain (Step #1 coat); a container 22 of pigmented, water-based graining coat emulsion (Step #2 coat) shown in an optional spray bottle, an optional brush 24, an optional applicator, which can comprise one or more of a brush, a cloth 26, a sponge 27, a scraper 28, or the like. Instructions for applying the two component grain coatings according to the process of the invention can be printed on the box or supplied as a package insert, not shown. An instruction sheet, shown in more detail in FIG. 4, is shown as 30. All can be packaged together in box or the like 32. Also optional can be sticks, e.g., as tongue depressors 34 or the like, gloves 36 and a bottle of wash used to prepare the substrate being worked on.

The following examples are provided to better explain and illustrate the invention but are not to be taken as limiting in any regard. Unless otherwise indicated, all parts and percentages are by weight and are based on the weight of the product or component at the indicated stage in processing.

EXAMPLE 1

A door panel of the type illustrated in FIG. 1, having a surface of polymer sealed fiberglass, is finished according to the invention. A Step #1 (base coat) coating having the following formulation is applied by brushing on the door panel to achieve a non-running, even coat. Approximately 5 to 6 ounces is used to coat one side of a door having a surface area of 32 square feet. This formulation is prepared to simulate oak when used with an appropriately formulated Step #2 (grain coat) coating, but the pigments could be selected complimentarily to simulate other wood types.

Step #1 Coat Formulation

| Ingredient | Parts by Weight |
|---|---|
| Self-Crosslinking Acrylic | 60.45 |
| Amine pH adjuster | 0.11 |
| Water | 5.44 |
| Glycol Ether Solvent | 7.12 |
| Associative Thickener | 0.25 |
| Nonionic surfactant | 0.18 |
| Anionic surfactant | 0.26 |
| Defoamer | 0.38 |
| Wax emulsion | 6.49 |
| Yellow Iron Oxide | 2.61 |
| Raw Sienna | 9.64 |
| Raw Umber | 1.16 |
| Titanium Pigment, white | 5.46 |
| Non-Urethane Thickener | 1.47 |
| Total | 100.02 |

Step #1 Coat Properties

| Property | Value |
|---|---|
| Volatiles, weight % | 59.7 |
| Volatiles, volume % | 63.8 |
| Solids, weight % | 40.2 |
| Solids, volume % | 36.1 |
| Density, grams per cc | 9.2 |
| VOC, grams per liter | 182.0 |
| VOC, pounds per gallon | 1.5 |
| Volatile Organic Emissions, grams/liter | 81 |
| Application temperature | 65° F. |

A Step #2 coating having the following formulation is applied by spray bottle to the door panel to achieve a light coating. Approximately 1.5 ounces is used to coat each side of the door. The coating is applied using the following recommended manner:

1. Using the enclosed spray bottle of 'Grain Coat', spray apply the 'Grain Coat' onto the raised panels of the door.
2. Next, using the nearly dry brush—dry brush the 'Grain' coat to spread it evenly and into the 'ticks'.
3. Next, use the flat side of the brush to push the 'grain coat' into the grain by holding it flat and drag it at a 45 degree cross-angle to the grain. This method removes excess grain coat and produces an even look to the part.

4. Brush out the corners and deep recesses—removing excess grain coat. Wipe the brush dry with the cloth—then use its 'flat side' to tone the recesses.
5. The spray application method enhances the overall effect and finishes the door in rapid fashion.

Note: It need be used only sparingly.

The door is air dried for 5 hours and gives the appearance of a natural oak wood door.

Step #2 Coat Formulation

| Ingredient | Parts by Weight |
|---|---|
| Water reducible Alkyd | 13.45 |
| Solvent (Texanol) | 1.84 |
| Cobalt Dryer | 0.09 |
| Amine pH adjuster | 0.59 |
| Water | 63.48 |
| Self-Crosslinking Acrylic | 4.24 |
| Diethylene Glycol | 0.58 |
| Anionic surfactant | 0.06 |
| Defoamer | 0.03 |
| Wax emulsion | 3.11 |
| Anti skinning agent (OMG-SKINO #2) | 0.23 |
| Propylene Glycol | 3.13 |
| Raw Umber | 1.65 |
| Burnt Umber | 6.00 |
| Yellow Iron Oxide | 1.72 |
| Titanium Pigment, white | 0.73 |
| Total | 100.93 |

Step #2 Coat Properties

| Property | Value |
|---|---|
| Volatiles, weight % | 77.9 |
| Volatiles, volume % | 79.2 |
| Solids, weight % | 22.0 |
| Solids, volume % | 20.7 |
| Density, grams per cc | 8.6 |
| VOC, grams per liter | 274.0 |
| VOC, pounds per gallon | 2.2 |
| Volatile Organic Emissions, grams/liter | 77 |
| Application temperature | 65° F. |

EXAMPLE 2

The Step #1 and Step #2 coating compositions of Example 1 were utilized according to this example to coat a door by a process which varied only in the manner of application of the Step #2 coating. In this case, the Step #2 coating was applied with a brush, applying 4 ounces to the door surface. Then, excess was scraped off with a paper squeegee, the surface was then wiped with a water wetted, damp cotton cloth. The results were essentially the same as those achieved in Example 1.

EXAMPLE 3

A door panel of the type illustrated in FIG. 1, having a surface of polymer sealed fiberglass, is finished according to the invention. A Step #1 coating having the following formulation is applied by brushing on the door panel to achieve a non-running, even coat. Approximately 5 to 6 ounces is used to coat one side of a door having a surface area of 32 square feet. This formulation is prepared to simulate mahogany when used with an appropriately formulated Step #2 coating, but the pigments could be selected complimentarily to simulate other wood types.

Step #1 Coat Formulation

| Ingredient | Parts by Weight |
|---|---|
| Self-Crosslinking Acrylic | 72.7 |
| Amine pH adjuster | 0.03 |
| Water | 8.4 |
| Dipropylene Glycol Ether Solvent | 3.18 |
| Rheological additive | 0.30 |
| Nonionic surfactant | 0.26 |
| Dipropylene Glycol N-Propyl Ether Solvent | 4.77 |
| Defoamer | 0.35 |
| Quinacridone Red | .07 |
| Yellow Iron Oxide | 3.65 |
| Burnt Sienna | 1.97 |
| Burnt Umber | 2.98 |
| Titanium Pigment, white | 1.30 |
| Non-Urethane Thickener | 0.03 |
| Total | 100.00 |

Step #1 Coat Properties

| Property | Value |
|---|---|
| Volatiles, weight % | 64.39 |
| Volatiles, volume % | 67.3 |
| Solids, weight % | 35.6 |
| Solids, volume % | 32.6 |
| Density, grams per cc | 8.8 |
| VOC, grams per liter | 217.1 |
| VOC, pounds per gallon | 1.81 |
| Volatile Organic Emissions, grams/liter | 92 |
| Application temperature | 65° F. |

Step #2 Coat Formulation

| Ingredient | Parts by Weight |
|---|---|
| Self-Cross linking Urethane/Acrylic | 23.83 |
| Solvent Dipropylene Glycol Normal Butyl Ether | 2.60 |
| Propylene Glycol | 2.72 |
| Water | 61.71 |
| Nonionic surfactant | 0.113 |
| Rheological additive | 1.395 |
| Cellulosic Rheological additive | 0.608 |
| Quinacridone Violet | 2.84 |
| Burnt Umber | 2.89 |
| Quinacridone Red | 0.74 |
| Teraplex Tinting Black | 0.52 |
| Total | 99.966 |

Step #2 Coat Properties

| Property | Value |
|---|---|
| Volatiles, weight % | 86.8 |
| Volatiles, volume % | 89.1 |
| Solids, weight % | 13.1 |

-continued

Step #2 Coat Properties

| Property | Value |
|---|---|
| Solids, volume % | 10.8 |
| Density, grams per cc | 8.6 |
| VOC, grams per liter | 435. |
| VOC, pounds per gallon | 3.6 |
| Material VOC, grams/liter (with water) | 84. |
| Application temperature | 65° F. |

EXAMPLE 4

A door panel of the type illustrated in FIG. 1, having a surface of polymer sealed fiberglass, is finished according to the invention. A Step #1 coating having the following formulation is applied by brushing on the door panel to achieve a non-running, even coat. Approximately 5 to 6 ounces is used to coat one side of a door having a surface area of 32 square feet. This formulation is prepared to simulate oak when used with an appropriately formulated Step #2 coating, but the pigments could be selected complimentarily to simulate other wood types.

Step #1 Coat Formulation

| Ingredient | Parts by Weight |
|---|---|
| Self-Crosslinking Acrylic | 60.45 |
| Amine pH adjuster | 0.11 |
| Water | 5.44 |
| Glycol Ether Solvent | 7.02 |
| Rheological additive | 0.25 |
| Nonionic surfactant | 0.18 |
| 0.1 N Silver Nitrate | 0.10 |
| Defoamer | 0.38 |
| Wax emulsion | 6.49 |
| Yellow Iron Oxide | 2.61 |
| Raw Sienna | 9.64 |
| Raw Umber | 1.16 |
| Titanium Pigment, white | 5.46 |
| Non-Urethane Thickener | 1.47 |
| Total | 100.02 |

Step #1 Coat Properties

| Property | Value |
|---|---|
| Volatiles, weight % | 59.7 |
| Volatiles, volume % | 63.8 |
| Solids, weight % | 40.2 |
| Solids, volume % | 36.1 |
| Density, grams per cc | 9.2 |
| VOC, grams per liter | 182.0 |
| VOC, pounds per gallon | 1.5 |
| Volatile Organic Emissions, grams/liter | 81 |
| Application temperature | 65° F. |

A Step #2 coating having the following formulation is applied by a dampened foam sponge pad or industrial spray equipment to the door panel to achieve a light coating. Approximately 1.5 ounces is used to coat each side of the door. The light coating is dry brushed with a nylon/polyester blend bristle brush or by use of a dampened foam sponge pad sufficiently to move at least some of the Step #2 coating into the great majority of grain ticks.

Step #2 Coat Formulation

| Ingredient | Parts by Weight |
|---|---|
| Self-Cross linking Urethane/Acrylic | 32.9 |
| Solvent Dipropylene Glycol Normal Butyl Ether | 4.5 |
| Additional Crosslink Agent | 4.3 |
| Water | 46.504 |
| Nonionic surfactant | 0.113 |
| Rheological additive | 1.395 |
| 0.1 N Silver Nitrate | 0.10 |
| Raw Umber | 1.56 |
| Burnt Umber | 5.69 |
| Yellow Iron Oxide | 1.63 |
| Titanium Pigment White | 0.69 |
| Total | 100.00 |

Step #2 Coat Properties

| Property | Value |
|---|---|
| Volatiles, weight % | 75.9 |
| Volatiles, volume % | 80.1 |
| Solids, weight % | 24.0 |
| Solids, volume % | 19.8 |
| Density, grams per cc | 8.8 |
| VOC, grams per liter | 170. |
| VOC, pounds per gallon | 1.4 |
| Material VOC, grams/liter (with water) | 40. |
| Application temperature | 65° F. |

The door is air dried for 3 hours and gives the appearance of a natural oak wood door.

EXAMPLE 5

The Step #1 and Step #2 coating compositions of Example 4 were utilized according to this example to coat a door by a process which varied only in the manner of final drying, using an oven for 20-30 minutes at 120-140° F. The results were essentially the same as those achieved in Example 4.

EXAMPLE 6

The Step #1 and Step #2 coating compositions of Example 4 were utilized according to this example to coat a door by a process which varied only in the manner of final drying, this time air drying for 4-8 minutes and then drying in a halogen oven for 2-5 minutes at 100-140 ° F. The results were essentially the same as those achieved in Example 4.

EXAMPLE 7

The Step #1 and Step #2 coating compositions of Example 4 were utilized according to this example to coat a door by a process which varied only in the manner of applying the step #2 coat. Here, a small amount of step #2 coat is squeezed from a bottle have a conical applicator onto a water-dampened terrycloth covered foam sponge pad as shown in the drawing as 27. This procedure is continued to add the step #2 coat as progress is made over the surface of the door. The water on the pad delays drying until application is finished.

The above description is intended to enable the person skilled in the art to practice the invention. It is not intended to detail all of the possible modifications and variations that will become apparent to the skilled worker upon reading the description. It is intended, however, that all such modifications and variations be included within the scope of the invention that is seen in the above description and otherwise defined by the following claims. The claims are meant to cover the indicated elements and steps in any arrangement or sequence that is effective to meet the objectives intended for the invention, unless the context specifically indicates the contrary.

The invention claimed is:

1. A process for imparting a wood grain and coloration to a textured substrate having a patterned texture surfaces with grain-like recesses therein, comprising:

(1) applying an opaque, pigmented, coating composition as a base coat having a base coat color;

(2) drying the base coat;

(3) applying a pigmented, water-based graining coat having a graining coat color in an amount sufficient to provide a darkening color to the grain-like recesses in the substrate and to the base coat; and (4) spreading the pigmented graining coat to color at least a majority of the grain-like recesses in the substrate, while retaining a coating of that graining coat on the texture surface, which pigmented graining coat partially screens and color modifies the base coat color to thereby provide a natural look in terms of wood grain and coloration of a selected wood type; and (5) drying the graining coat to provide said wood grain and coloration.

2. A process according to claim 1, wherein the graining coat is applied at a rate of from about 1 to 3 ounces per 32 square feet of surface.

3. A process according to claim 1, wherein the base coat comprises a crosslinkable acrylic.

4. A process according to claim 1, wherein the graining coat comprises a cros slinkable urethane/acrylic.

5. A process for imparting a wood grain to a textured surface having a pattern of texture surfaces with grain-like recesses therein, comprising:

(1) applying to a wood-grain textured substrate an opaque, pigmented, water-based base coat, comprising a) a crosslinking acrylic polymer; b) a surfactant component; c) a water-soluble, aqueous solvent for the polymer; and d) a pigment component;

(2) drying the base coat;

(3) applying a pigmented, water-based graining coat over the base coat in an amount sufficient to partially screen and modify the base coat color and darkening the color of at least a majority of the grain-like recesses in the substrate said pigmented, water-based graining coat providing a finish that exhibits the coloration and graining of a predetermined wood-characterized by ultraviolet light stability; and (4) air drying the graining coat.

6. A process for imparting a repairable wood grain to a textured surface having a pattern of texture surfaces with recesses therein, comprising:

(1) applying to an adherent wood-grain textured substrate an opaque, pigmented, water-based paint emulsion base coat comprising a) a crosslinkable acrylic polymer;

b) a surfactant component;

c) a water-soluble, aqueous solvent for the polymer; and d) a pigment component;

(2) drying the base coat;

(3) applying to the base coat following drying, a water-based pigmented, transparent but darkening graining coat in an amount sufficient to partially screen and modify the base coat color and darkening the color of at least a majority of the grain-like recesses in the substrate, comprising a) a crosslinkable acrylic;

b) a surfactant;

c) a water-soluble, aqueous solvent for the polymer; and d) a pigment component, wherein the pigmented graining coat containing the crosslinkable polymer provides a finish that imparts the coloration and graining of a predetermined wood characterized by ultraviolet light stability; and (4) air drying the graining coat.

7. A process according to claim 6 wherein the acrylic in the graining coat comprises a water reducible alkyd.

8. A process according to claim 6 wherein the acrylic in the graining coat comprises a urethane/acrylic.

* * * * *